US006305826B1

(12) United States Patent
Yang

(10) Patent No.: US 6,305,826 B1
(45) Date of Patent: Oct. 23, 2001

(54) LAMP ASSEMBLY WITH A CASING THAT PARTIALLY TRANSMITS LIGHT IN ORDER TO REDUCE SHADOWS

(76) Inventor: Jerry S. C. Yang, 8F-8, No. 10, Ta Lung Road, Taichung (TW)

( * ) Notice: Subject to any disclaimer, the term of this patent is extended or adjusted under 35 U.S.C. 154(b) by 0 days.

(21) Appl. No.: 09/398,465

(22) Filed: Sep. 17, 1999

Related U.S. Application Data

(63) Continuation-in-part of application No. 09/383,216, filed on Aug. 26, 1999, now abandoned.

(51) Int. Cl.[7] ..... F21S 17/00

(52) U.S. Cl. ..... 362/351; 362/360; 362/431; 362/367

(58) Field of Search ..... 362/367, 410, 362/414, 432, 311, 310, 360, 293, 363

(56) References Cited

U.S. PATENT DOCUMENTS

| | | | | |
|---|---|---|---|---|
| 3,964,194 | * | 6/1976 | Gugeler | 362/806 |
| 5,228,767 | * | 7/1993 | Johnson | 362/276 |
| 5,383,102 | * | 1/1995 | Jones | 362/290 |
| 5,404,264 | * | 4/1995 | Park | 362/363 |
| 5,473,525 | * | 12/1995 | Stout | 362/412 |
| 5,882,109 | * | 3/1999 | McKinney et al. | 362/311 |

* cited by examiner

*Primary Examiner*—Thomas M. Sember
(74) *Attorney, Agent, or Firm*—Bacon & Thomas

(57) ABSTRACT

A lamp assembly includes a light source, a lamp shade arranged to transmit light from the light source, and a casing arranged to accommodate the lamp shade, the casing and lamp shade substantially surrounding the light source. Although arranged to appear opaque when the light source is not illuminated, the casing is arranged to at least partially transmit light upon illumination of the light source so as to reduce shadows that would otherwise be cast by the casing.

16 Claims, 4 Drawing Sheets

LAMP ASSEMBLY WITH A CASING THAT PARTIALLY TRANSMITS LIGHT IN ORDER TO REDUCE SHADOWS

CROSS-REFERENCE TO RELATED APPLICATIONS

This application is a continuation-in-part of application Ser. No. 09/383,216 filed on Aug. 26, 1999, which is now abandoned.

BACKGROUND OF THE INVENTION (a) Field of the Invention

Lamp Assembly with a casing having a mild light-transmission effect.

(b) Description of the Prior Art

Conventionally, a lamp assembly, one executed to be a Garden Lamp and meant for erection on a floor surface for use, or else household desk lamps, wall lamps, chandeliers, and the like, are typically composed of a lamp casing and lamp shade, or additionally an erection stem in the case of applications for setting on a flat surface. The lamp casing compartment of a conventional lamp assembly, however, be it made of plastic base or metal material, is usually opaque so that when the lamp assembly is turned on for illumination the contour of the lamp casing will inevitably produce a shadow defined an such by projection, and that inevitably has negative effects an the intended illumination.

SUMMARY OF THE INVENTION

The primary object of the invention, therefore, is to provide a lamp assembly with a casing having a mild light-transmission effect, comprising essentially the lamp casing and the lamp shade of any shape or makeup, the lamp casing configured involute to accommodate the lamp shade. Both casing and shade may be structured independently and include a single constituent or multiple constituents, but these restricted to be materials of chosen light transmittances. The casing may be in module form, and may exhibit an atomization effect, or alternatively the surface of the casing may go through sandblasting treatment, the chosen light transmitting materials additives to different proportions admixed, painting may be applied to said surfaces, or sticker paper of chosen light transmittance may be applied to, the same surfaces, or still the casing surface may be vapor plated form a metal film which is partially or entirely incorporated with a mild light transmission effect, or the lamp casing and shade may retain a partial light blocking effect all the same. It is still practicable to have the shade compartment made of light transmitting material or glass or other translucent materials, and to entirely or partially exhibit a chosen light transmission effect so as to achieve a same wholesale light transmission or discriminating light transmission effect so that the entire lamp assembly will remain opaque when the light source remains unlit, but both the lamp casing and lamp shade will emit light when the light source is turned on at night, producing a Main Illumination Zone and a Complementary Illumination Zone with a mild light transmission effect almost clear of any shade, what strikes the view instead is a profile of the lamp assembly on illumination exhibiting an aesthetic feature at the same time.

DETAILED DESCRIPTION OF PREFERRED EMBODIMENTS

FIG. 1 through FIG. 5 illustrate by and large the basic structure of the invention Lamp Assembly with a casing having a Mild Light-Transmission Effect realized in the instance of a Garden Lamp Assembly, although the invention in its application is not restricted only to the illustrated example, out instead may be applied in other kinds of lamp assemblies including wall lamps, chandeliers, with or without an erection stem.

Figure 1:
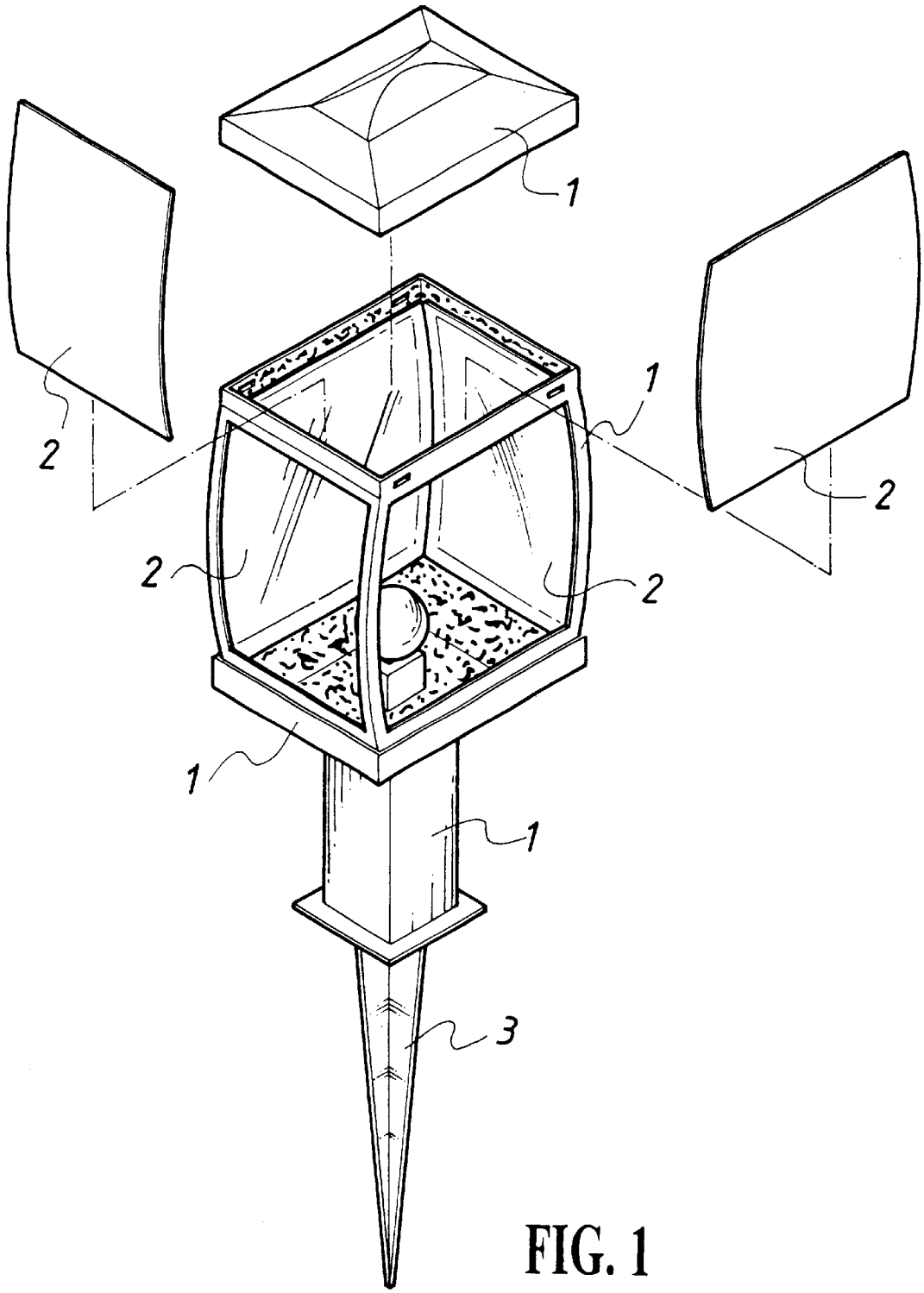
FIG. 1 is a three-dimensional analytical view of the invention embodied in the instance of a Garden Lamp Assembly.
Figure 2:
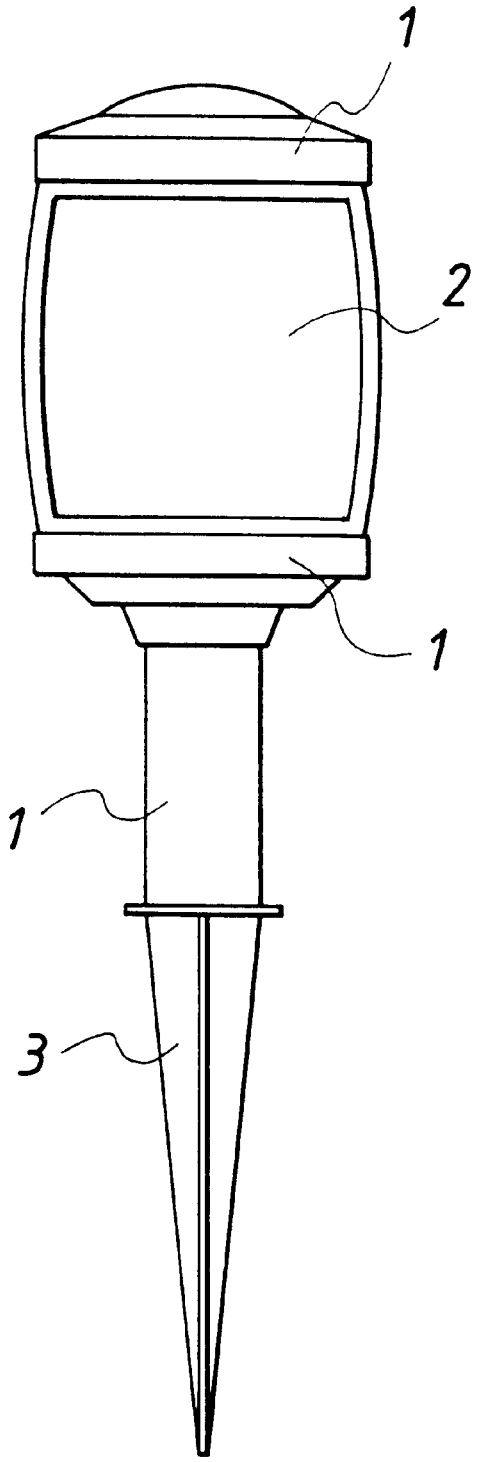
FIG. 2 is a side view of the invention accomplished of assemblage.
Figure 3:
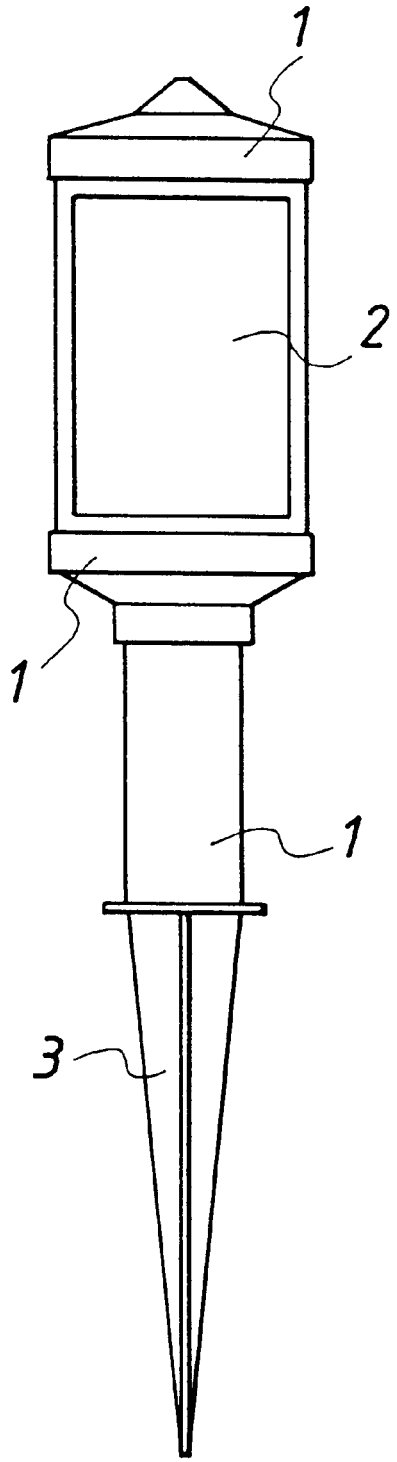
FIG. 3 is another side view of the invention accomplished of assemblage.

As shown, the invention realized in the instance of a Garden Lamp Assembly represented in FIG. 1 through FIG. 3 comprises essentially a lamp casing 1, a lamp shade 2 and an erection stem 3 whereof:

The casing 1, structured like an envelope, accommodates the shade 2. Either the casing 1 or the shade 2 may be made of a single or alternatively a plurality of constituents, to a chosen shape, from material of a given light transmittance, or else from materials of yet better light transmission performances defined or adjusted by means of: (1) module forming and atomization treatment where the materials employed are thermosetting or thermo-pressed articles; (2) surface sandblasting treatment; (3) otherwise tribologically applied atomization; (4) admixing of additives to suitable proportions; (5) surface finishing with Paint Stuff of a chosen light transmittance; (6) adhesion of paper sticker of chosen light transmittance internally or externally; or (7) steam plating to form a metal film of a chosen light transmittance; to achieve the realization of a lamp casing compartment which will exhibit a total or partial mild light transmission effect.

The lamp shade 2 compartment may further be made from perfect light transmission materials or obscured glass or otherwise semi-lucent materials to make for a lamp shade with wholesale or localized light transmission effect, executed to be one-piece constituent or else one composed of a number of components, of any configuration desired or as appropriate.

Figure 4:
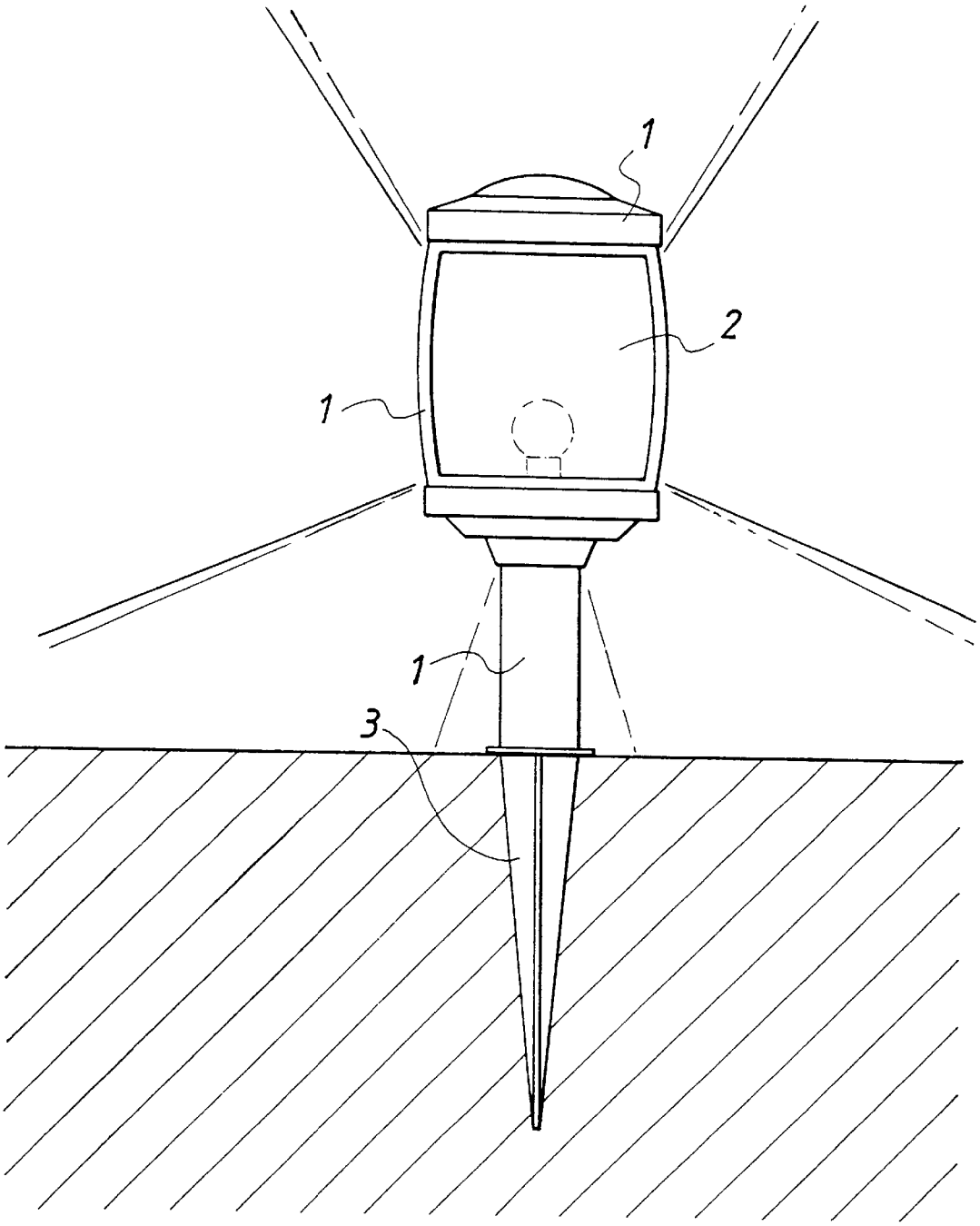
FIG. 4 is an illustration of the embodiment established by erection on a ground surface; and, FIG. 5 is an illustration of the Master, Complementary Illumination Zones realized pursuant to the Invention.

The erection stem 3, being installed way from the bottom of the casing l, may be embodied in a single piece or else in a series of components intended exclusively for use with a Garden Lamp, for erection firm on a ground surface, such as is shown in FIG. 4, but can be omitted in the execution of other regular lamp assemblies, and is reduced to be integral with the lamp casing compartment in those regular applications in respect of which further description is omitted altogether.

Figure 5:
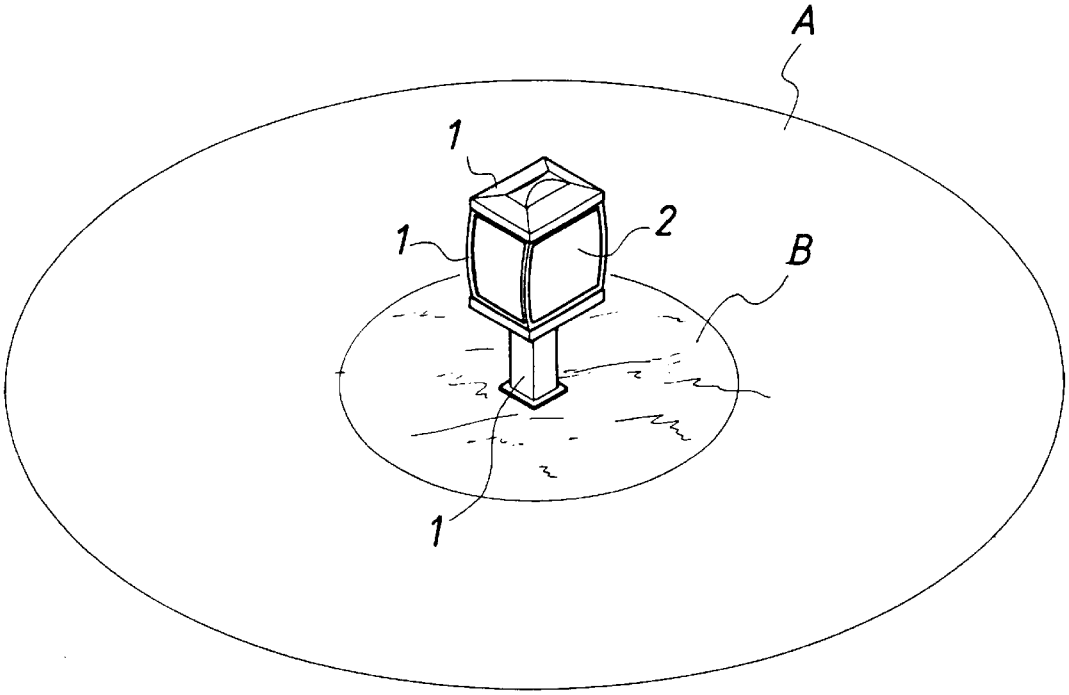

A lamp assembly composed of said lamp casing l,lamp shade 2, or contingently said erection stem 3, will provide for a chosen differential as regards light transmittance between lamp casing 1 and lamp shade 2, to the effect that the lamp assembly will remain opaque when the light source remains unlit, but will illuminate when turned on at night by way of both casing 1 and shade 2, seen in the activation of a Main Illumination Zone A and a Complementary Illumination Zone B, as better illustrated in FIG. 5, so that no shadow is cast from the casing 1, and a mild light transmission effect is thereby achieved permitting straight visual viewing of the profile of the lamp assembly on illumination to provide an overall aesthetic glamour.

For abatement of the light transmission effect coming from said lamp casing 1, and lamp shade 2 recommended procedures include: (1) direct shaping treatment, (2) subsequent abatement processing, (3) subsequent scale up treatment, and (4) additive pattern forming treatment, more specifically:

(1) direct shaping treatment, which refers to the presetting of a total or localized atomized surface in a thermoset or thermopress formed mold, so that for example raw materials of plastic base or acrylic once molded thereby will exhibit a total or localized translucent characteristics on the surface, while they remain opaque in daytime, a predetermined light transmission effect will be realized when activated after nightfall;

(2) subdequent abatement processing, which refers to atomizing treatment processed on semi-products in the form of thermoset or thermopressed plastic or acrylic raw materials, calling for sandblasting treatment or tribological scrubbing or scraping treatment on slick surfaces so as to produce a total or localized atomized state with a mild light transmission effect;

(3) subsequent scale up treatment, which refers to paint finishing of lamp casing or lamp shade surfaces, this being a localized finish to a proportion as desired, or alternatively as executed by the adhesion of a paper sticker of chosen light transmittance internally or externally, or by vapor plating to develop a metal film to a chosen light transmittance;

(4) additive pattern forming treatment, which refers to the addition of glass fiber or carbon fibre or mica, or opaque metal particulate, or opaque foils, or insoluble colored particles in plastic raw materials such as PP, PS, acrylic or similar stuffs, in order to produce a lamp casing or lamp shade featuring a mild light transmission effect; that is, prior admixturing of carbon fiber, copper powder or glass fiber, similar additives to a predetermined proportion, or optionally also of color powder to achieve colored light transmission effect. Alternatively, to further mark up opaque effects, it is practicable to add black pigment of a chosen percentile ratio, or still anti-ultra violet agents, still of a chosen proportion, with a view to still better enhance said mild light transmission effect. Said opaque metal powder can be singly silver, copper, gold, or ferrous particles, or other opaque metal base powder, or mixtures thereof, said opaque metal foils can be singly that of silver, copper, gold, iron, aluminum, zinc/platinum or otherwise, or mixtures thereof, said addition of insoluble colored powder can be singly that of marble, granite, black aurous stones, golden bead powder, other colored nonmetallic materials or mixtures thereof.

In summation, this invention, in the name of lamp assembly with a casing having a mild light transmission effect, is truly innovative in that while it remains opaque when the light source remains unlit, the assembly will illuminate, producing a Main Illumination Zone and a Complementary Illumination Zone thanks to the differential of light transmittance created for the lamp casing in contrast to the lamp shade, with shadow kept to the minimum in the meantime, when turned on at night, and that exhibiting in the meanwhile an overall esthetic feature denied to conventional lamps of whatever design known to date.

What is claimed is:

1. A lamp assembly, comprising:

a light source;

a lamp shade arranged to transmit light from said light source;

a casing arranged to accommodate said lamp shade, said casing and said lamp shade substantially surrounding said light source, wherein said casing has a reduced transmittance relative to said casing such that said casing appears to be opaque when the light source is not illuminated, and yet transmits light from said light source when said light source is illuminated to thereby reduce shadows cast by said lamp assembly.

2. A lamp assembly as claimed in claim 1, wherein said lamp shade is transparent.

3. A lamp assembly as claimed in claim 1, wherein said casing is translucent.

4. A lamp assembly as claimed in claim 1, wherein said casing is formed of a translucent material.

5. A lamp assembly as claimed in claim 1, wherein said casing is formed of a transparent material having a surface treatment that reduces transmission of light.

6. A lamp assembly as claimed in claim 5, wherein said surface treatment includes atomization of surfaces of said casing.

7. A lamp assembly as claimed in claim 5, wherein said surface treatment includes sandblasting of surfaces of said casing.

8. A lamp assembly as claimed in claim 5, wherein said surface treatment includes painting of surfaces of said casing.

9. A lamp assembly as claimed in claim 5, wherein said surface treatment includes applying sticker paper of a selected light transmittance to said surfaces.

10. A lamp assembly as claimed in clam 5, wherein said surface treatment includes vapor plating said surfaces to form a partially transparent metal film.

11. A lamp assembly as claimed in claim 1, wherein said casing is made of a plastic material whose light transmission properties are determined by additives to said plastic material.

12. A lamp assembly as claimed in claim 11, wherein said additives include opaque metal particles.

13. A lamp assembly as claimed in claim 11, wherein said additives include an opaque colored powder.

14. A lamp assembly as claimed in claim 1, wherein said casing and lamp shade are discrete member.

15. A lamp assembly as claimed in claim 1, wherein said casing and lamp shade are sections of a single structure that substantially surrounds said light source.

16. A lamp assembly as claimed in claim 1, wherein said lamp assembly is a decorative garden lamp having a stake extending from said casing for insertion into ground to support said lamp assembly.

* * * * *